United States Patent [19]

Scheel

[11] 4,357,875

[45] Nov. 9, 1982

[54] CONVEYOR SYSTEM WITH ACCESS WAY

[75] Inventor: Russell Scheel, Easton, Pa.

[73] Assignee: SI Handling Systems, Inc., Easton, Pa.

[21] Appl. No.: 209,811

[22] Filed: Nov. 24, 1980

[51] Int. Cl.[3] ..... B61J 1/10

[52] U.S. Cl. ..... 104/50; 104/48; 104/90; 104/166; 198/472

[58] Field of Search ..... 104/48, 50, 90, 96, 104/98, 165, 166; 198/472, 408, 861

[56] References Cited

U.S. PATENT DOCUMENTS

| | | | |
|---|---|---|---|
| 2,478 | 3/1842 | Leach | 104/90 |
| 719,979 | 2/1903 | Turner | 104/90 |
| 3,356,040 | 12/1967 | Fonden | 104/166 X |
| 3,818,837 | 6/1974 | Jacoby | 104/166 |
| 3,903,810 | 9/1975 | Jones | 104/166 |
| 4,059,053 | 11/1977 | Jones | 104/35 |
| 4,070,972 | 1/1978 | Folsom et al. | 104/98 X |
| 4,074,632 | 2/1978 | Kurahasi et al. | 104/166 X |
| 4,132,174 | 1/1979 | Ziegenfus | 104/48 |

FOREIGN PATENT DOCUMENTS

| | | | |
|---|---|---|---|
| 2248220 | 4/1974 | Fed. Rep. of Germany | 134/73 |

*Primary Examiner*—Randolph Reese

*Attorney, Agent, or Firm*—Seidel, Gonda, Goldhammer & Panitch

[57] ABSTRACT

The conveyor track of a conveyor system is provided with an access way so that persons or vehicles may traverse the tracks without interfering with movement of driverless vehicles along the conveyor. A shuttle is suspended from above and supported for reciprocatory movement across a gap in the track. The vehicles traverse the gap by way of the shuttle.

11 Claims, 5 Drawing Figures

CONVEYOR SYSTEM WITH ACCESS WAY

BACKGROUND

Floor mounted conveyor systems having tracks for driverless vehicles present a problem of how to cross the tracks. One solution is to build steps from the floor level up to the level of the tracks. A platform may be provided between the tracks. That solution is only applicable to persons who seek to traverse the tracks.

If the conveyor system is an endless loop having dimensions such as 15 meters and 250 meters long, the problem of access across the tracks to the space within the loop persists. With an endless loop of that size, it is necessary to utilize the space within the loop with machinery. In order to locate the machinery within the loop, provide maintenance on machinery in the loop, provide transportation for raw materials, etc. it is necessary that any access way accommodate material handling equipment such as a fork lift truck. In such a situation, steps over the track are an unacceptable solution. Providing a section of the track which is removable to facilitate access is likewise unacceptable since it interferes with the operation of the conveyor.

The present invention is directed to a solution of the problem of providing access across the conveyor system having tracks for driverless vehicles, facilitating such access by material handling equipment, while accomplishing such access without interfering with movement of driverless vehicles along the track.

SUMMARY OF THE INVENTION

The present invention is directed to a conveyor having a conveyor track for driverless vehicles. An access way is provided across a portion of the conveyor tracks. The access way includes a gap in the conveyor track. A shuttle is suspended from above and supported for reciprocatory movement across the gap from a vehicle receiving position at one end of the gap to a vehicle discharging position at the other end of the gap.

The length of the shuttle is substantially less than the length of the gap whereby an unoccupied portion of the gap is the access way. The shuttle includes a surface for supporting a driverless vehicle. A means is provided for moving a driverless vehicle from one portion of the track onto the shuttle when the shuttle is in its receiving position and for moving the driverless vehicle off the shuttle onto another portion of the track when the shuttle is in its discharging position.

It is an object of the present invention to provide a conveyor system having a track for vehicles while including an access way across the track which does not interfere with movement of vehicles along the track.

It is an object of the present invention to provide a closed loop conveyor system with an access way which facilitates entry into the loop by motor driven material handling equipment.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figures 1, 2:
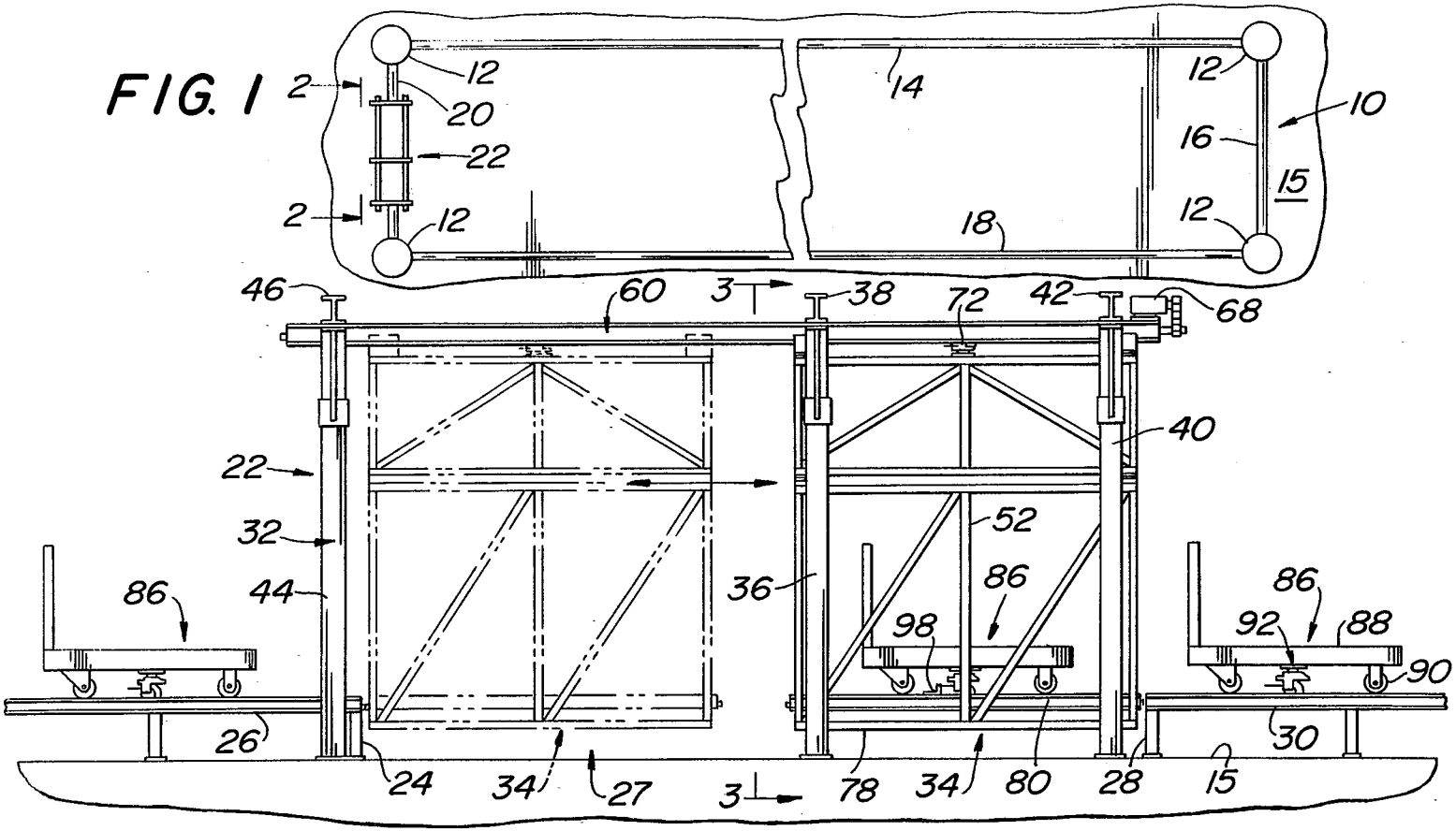
FIG. 1 is a diagramatic plan view of a conveyor system in accordance with the present invention.
FIG. 2 is an elevation view taken along the line 2—2 in FIG. 1 but on an enlarged scale.

Referring to the drawings in detail, wherein like numerals indicate like elements, there is shown in FIG. 1 a diagramatic plan view of a closed loop conveyor system designated generally as 10. The means for providing an access way across tracks of the conveyor system is equally applicable to a conveyor system which is not a closed loop. The system 10 as disclosed herein includes turn tables 12 interconnected by track sections 14, 16, 18 and 20 to thereby define the closed loop. The turn tables and track sections are supported by and above the elevation of a floor 15.

One or more of the track sections 14, 16, 18 and 20, such as track section 20 is provided with a shuttle system 22 to facilitate access across track section 20. In a preferred embodiment wherein the enclosed space within the system 10 is quite substantial and wherein floor 15 is the floor of a production plant, the access way must be sufficiently large so as to accommodate motor driven material handling equipment such as fork lift trucks. In that regard, the preferred access way has a width of 3 to 4 meters at a height of 3 to 4 meters.

Track section 20 includes a pair of aligned track portions 26 and 30. See FIG. 2. Track portion 26 terminates in an end 24. Track portion 30 terminates in an end 28. A gap 27 is provided between the ends 24, 28.

In the gap 27, there is provided a shuttle system 22 which includes a frame designated 32. The frame 32 supports a shuttle vehicle designated generally as 34. The shuttle vehicle has a length which is substantially less than the length of the gap 27 as shown more clearly in FIG. 2. As described in greater detail hereinafter, the shuttle vehicle 34 is supported by the frame 32 for reciprocation across the gap 27 from a vehicle receiving position as shown in solid lines in FIG. 2 to a vehicle discharge position as shown in phantom lines in FIG. 2.

The frame 32 includes a pair of upright posts 36 in a central zone of the gap 27. The posts 36 are interconnected at their upper ends by a girder 38. See FIGS. 2 and 3. Frame 32 includes another pair of uprights posts 40 interconnected at their upper ends by a girder 42 adjacent the end 28 of track portion 30. Frame 32 includes another pair of upright posts 44 interconnected at their upper ends by a girder 46 adjacent the end 24 of track portion 26. The above mentioned access way is that portion of gap 27 between posts 36 and posts 44.

A pair of parallel tracks 48, 50 are secured at their upper ends to the girders 46, 38, 42. See FIG. 3. The shuttle vehicle 34 includes side frames 52, 54 interconnected transversely by struts 56. The shuttle vehicle 34 is suspended from the tracks 48, 50 by wheel structure 58, 60 respectively.

Figure 4:
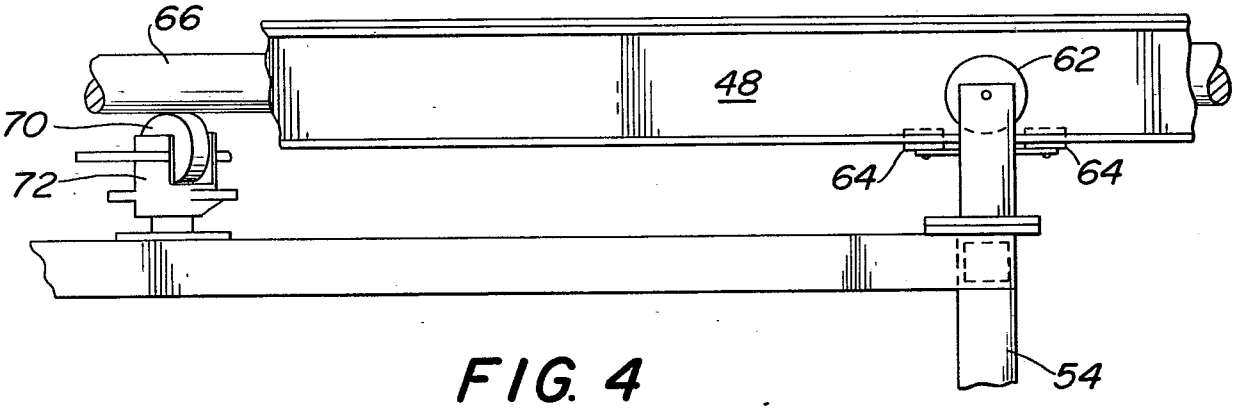
FIG. 4 is a partial side elevation view of the upper end of the shuttle.

The wheel structures 58, 60 are identical. Each such wheel structure includes a wheel 62 adjacent opposite ends of the vehicle 34 for rolling contact with a horizontal surface on the tracks 48, 50. A pair of wheels 64 is associated with each of the wheels 62 for rolling contact with an inside edge of the tracks 48, 50. See FIG. 4. The combination of four wheels 62 and eight wheels 64 prevents the shuttle car 34 from shifting sideways with respect to the tracks 48, 50.

A drive tube or shaft 66 is rotatably supported by the girders 46, 38 and 42 at an elevation below the girders. See FIG. 3. The drive tube 66 is between and parallel to the tracks 48, 50. Drive tube 66 is rotated about its longitudinal axis by motor 68. See FIGS. 2 and 3.

One of more drive wheels 70 is provided at the upper end of the shuttle vehicle 34. Each drive wheel 70 is in rolling contact with the drive tube 66 and is provided with a oscillatible support 72 spring biassed to a drive position. Motor 68 is preferably a reversable motor so that it may cause the shuttle vehicle 34 to reciprocate between a vehicle receiving position and a vehicle discharging position.

Figure 3:
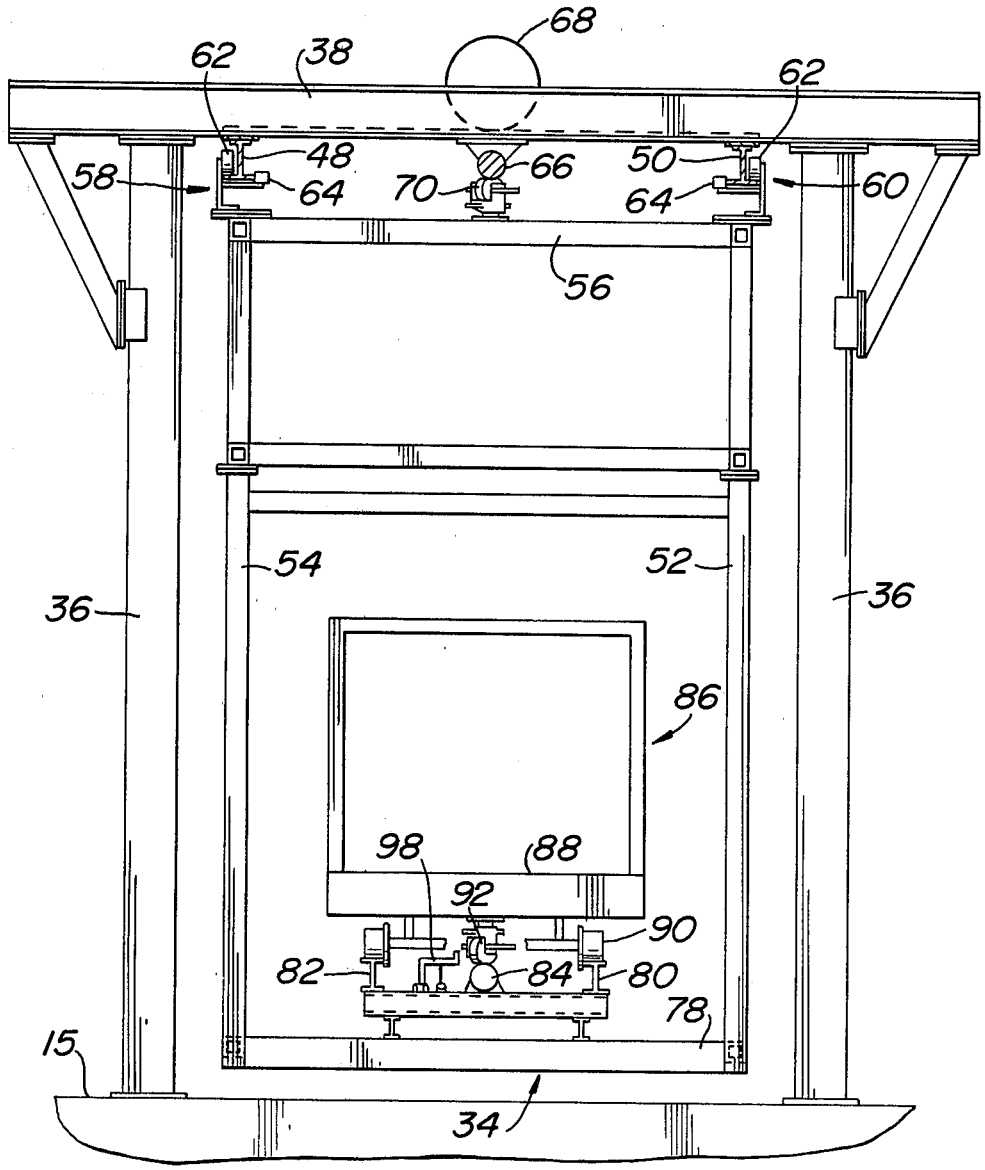
FIG. 3 is a sectional view taken along the line 3—3 in FIG. 2 but on an enlarged scale.

Referring to FIG. 3, at the lower end of the shuttle vehicle 34 there is provided a platform 78 spaced from the floor 15. On the platform 78 there is provided support structure including a pair of tracks 80, 82 which are aligned with the tracks of track portions 26 and 30. The driverless vehicles of the system 10 are designated generally as 86. Each vehicle 86 includes a load supporting platform 88 mounted on wheels 90. The wheels 90 ride on the tracks 80, 82 as well as the tracks of the various track sections 14, 16, 18 and 20.

Figure 5:
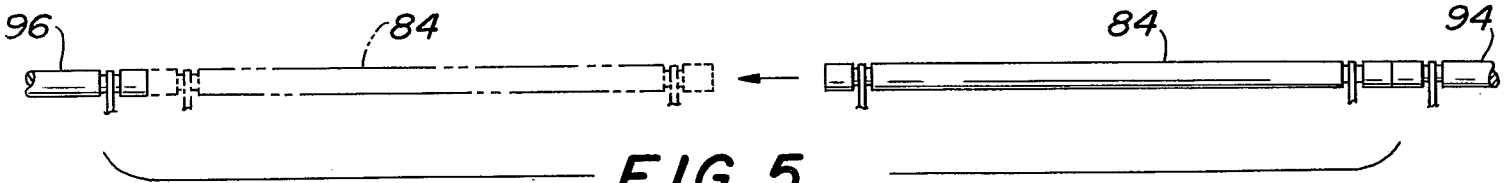
FIG. 5 is a diagramatic view showing the shuttle drive tube in a vehicle receiving position and in a vehicle discharging position.

A drive tube or shaft 84 is rotatably supported on the platform 78 between the tracks 80, 82. Drive tube 84 is preferably not provided with its own drive motor. Drive tube 84 is at an elevation corresponding to the elevation of the drive tube 94 associated with track portion 30 and the drive tube 96 associated with the track portion 26. See FIG. 5. The drive tubes 84, 94 and 96 are coaxial. Drive tube 84 terminates at its ends in a friction pad. When the shuttle vehicle 34 is in the vehicle receiving position shown in solid lines in FIG. 2, the friction pad at one end of the drive tube 84 is in contact with a mating end of the drive tube 94. As a result thereof, the motor (not shown) which rotates drive tube 94 about its longitudinal axis also drives tube 84 about its longitudinal axis in the same direction. As a result thereof, a separate drive motor is not needed in order to facilitate transfer of a driverless vehicle 86 from track portion 34 onto the shuttle vehicle 34. In a similar manner, vehicle 86 will transfer off the shuttle vehicle 34.

Each of the driverless vehicles 86 has a drive 92 in contact with a drive tube such as drive tubes 84, 94, 96, etc. At any location along the track sections 14, 16 and 18 there may be provided a speed control member for automatically causing the vehicle to come to a stop or accumulation position at a work station. One such speed control member which may be utilized to rotate the drive wheel and cause the vehicle to stop is disclosed in U.S. Pat. No. 3,903,810. The shuttle vehicle 34 is preferably provided with a similar control member and designated 98 so as to cause the vehicles 86 to stop after they have been transferred onto the shuttle vehicle 34.

In the system 10, transfer from track section 14 to track section 16, for example, is accomplished by way of a turn table 12. Any conventional turn table may be utilized. If desired, and if the environment permits, the loop of the system 10 may have curves in place of turn tables. Turn tables 12 are preferred since they provide a control function in large systems. A speed control member such as the control member disclosed in U.S. Pat. No. 3,903,810 may be provided upstream from each of the turn tables. Vehicles will accumulate and will not enter the turn table unless a microswitch is tripped thereby indicating that the shuttle vehicle 34 is in a vehicle receiving position.

OPERATION

Driverless vehicles 86 traverse the loop of system 10. The vehicles automatically accumulate and/or stop at work stations along the loop. If the turn table 12 interconnecting track sections 18 and 20 is not released by the shuttle car 34, vehicles will accumulate at that turn table. When the vehicle 34 is in a vehicle receiving position as shown at the right hand end of FIG. 2, the turn table 12 is released whereby a vehicle will transfer from track section 18 to track section 20, and will transfer onto the tracks 80, 82 on the shuttle vehicle 34. Drive tube 84 will be driven by drive tube 94 to facilitate such transfer. Control member 98 cams the support for drive wheel 92 to a accumulation position thereby stopping the vehicle 86 on the platform 78.

While the shuttle vehicle 34 is in its vehicle loading position, the access way which is part of the gap 27 permits vehicles and/or persons to enter the loop of the system. When a vehicle 86 has been transferred onto the shuttle car 34 as shown in FIG. 2, and has come to a stop, it trips a microswitch (not shown) which starts motor 68, and latches the turn table 12 immediately upstream therefrom. At the same time, a visual and/or audible signal may be generated to thereby warn vehicles and persons that the shuttle vehicle 34 is about to traverse the access way.

As motor 68 rotates the drive tube 66, the shuttle vehicle 34 moves to the phantom position shown at the lefthand end of FIG. 2. As the shuttle vehicle 34 reaches its vehicle discharge position, the following occur: (a) the support for drive wheel 70 is cammed by a speed control member as described above to an accumulation position whereby the shuttle vehicle 34 stops; (b) the friction pad at the left end of the drive tube 84 contacts an end face on the drive tube 96 whereby drive tube 84 commences rotating about its longitudinal axis; and (c) the speed control member 98 is released whereby the drive wheel 92 under spring pressure is biassed to a drive position and transfers off the tracks 80, 82 onto the tracks of the track portion 26.

After traversing a portion of the tracks on portion 26, the vehicle trips a microswitch which reverses motor 68 and releases the speed control member which is camming the support for drive wheel 70 in an accumulation position. As a result thereof, the shuttle vehicle 34 returns to its vehicle receiving position at the righthand end of FIG. 2. Any audible or visual signals for warning personnel or vehicles that the access way is unavailable will terminate when the shuttle vehicle 34 returns to its vehicle receiving position. Thereafter, the sequence of events is repeated with the access way being open again for use by persons or vehicles. While the shuttle vehicle 34 was in the phantom position shown in FIG. 2, the access way is blocked.

Thus, it will be seen that the present invention facilitates access across a conveyor track or into the space within an endless conveyor loop by persons or vehicles without interfering with the movement of driverless vehicles along the track. As will be apparent from the description herein, use of the access way is intermittent.

The number and type of work stations along conveyor system 10 is optional. The work performed on a load supported by platform 88 of the vehicles 86 can include, welding, riveting, drilling, etc. The speed of motor 68 should be chosen so that the time lapse for reciprocating the shuttle vehicle 34 is compatible with the time lapse at the work stations whereby the shuttle system 22 is not a bottleneck.

If desired a control member may be provided along track section 20 between turntable 12 and the shuttle system 22 to cause accumulation of vehicles at the option of a fork lift operator. That feature will enable the gap 27 to be available more rapidly and for longer periods of time without effecting operation of system 10 at the work stations.

The present invention may be embodied in other specific forms without departing from the spirit or essential attributes thereof and, accordingly, reference should be made to the appended claims, rather than to the foregoing specification, as indicating the scope of the invention.

I claim:

1. A conveyor comprising a conveyor track for driverless vehicles, means to facilitate access across a portion of the conveyor track, said means including a gap in the conveyor track, a shuttle vehicle supported for reciprocatory movement across the gap from a vehicle receiving position at one end of the gap to a vehicle discharging position at the other end of the gap, the length of said shuttle vehicle being less than the length of the gap whereby an unobstructed portion of the gap is an access way, said shuttle vehicle having means to support a driverless vehicle and means for moving a driverless vehicle from one portion of the track onto said shuttle vehicle when in its receiving position and for moving a driverless vehicle off the shuttle vehicle onto another portion of the track when the shuttle vehicle is in its discharging position.

2. A conveyor in accordance with claim 1 wherein said shuttle vehicle is suspended from above by a frame, said shuttle vehicle having a drive wheel at its upper end in contact with a drive tube supported by said frame, and a reversible motor coupled to said drive tube for rotating the drive tube about its longitudinal axis to thereby reciprocate said shuttle vehicle.

3. A conveyor in accordance with claim 1 wherein said shuttle vehicle has a drive tube thereon aligned with a drive tube associated with the conveyor tracks at opposite ends of the gap, said means for moving a driverless vehicle onto the shuttle vehicle including driving the drive tube on the shuttle vehicle by one of the last mentioned conveyor track drive tubes.

4. A conveyor in accordance with claim 1 wherein said conveyor tracks are arranged to form a closed loop.

5. Apparatus comprising a driverless vehicle conveyor supported from below by a floor, said conveyor having an unobstructed gap through which objects on the floor may pass, a shuttle vehicle supported from above for intermittent reciprocatory movement across the gap, said shuttle vehicle having a platform at the lower end of said shuttle vehicle and at substantially the same elevation as said conveyor for supporting driverless vehicles and transferring them from one end of the conveyor to the other across said gap, and means associated with the shuttle vehicle to facilitate transferring driverless vehicles onto and off said platform when the shuttle is at one end of its reciprocatory movement.

6. A conveyor in accordance with claim 5 wherein said shuttle vehicle is suspended from above by a frame, a drive tube on said frame, a drive wheel on said shuttle vehicle and in contact with the lower periphery of said drive tube, and a reversible motor for rotating said drive tube about its longitudinal axis to thereby reciprocate said shuttle vehicle.

7. An endless loop conveyor having tracks for supporting driverless vehicles capable of being stopped at predetermined locations along the length of the conveyor, each vehicle having a drive wheel for driving contact with a drive tube, each drive wheel being movable between a drive position and an accumulation position, means biassing each drive wheel to its drive position, the improvement comprising means to intermittently facilitate access across the conveyor into the loop defined by the conveyor, said means including a gap in a straight portion of the conveyor tracks defined by aligned track ends, a shuttle vehicle suspended by a frame from above and supported for reciprocatory movement across the gap from a vehicle receiving position at one track end to a vehicle discharging position at the other track end, the length of the shuttle vehicle being less than the length of the gap whereby an unobstructed portion of the gap is intermittently available as an access way.

8. A conveyor in accordance with claim 7 including means for facilitating use of the rotation of a drive tube at one end of the track adjacent the gap for moving driverless vehicles onto the shuttle vehicle and for using a drive tube adjacent one end of the track at the opposite end of the gap for moving driverless vehicles off the shuttle vehicle.

9. A conveyor in accordance with claim 8 wherein the last mentioned means includes a drive tube on the shuttle vehicle aligned with and adapted to contact an end of the drive tubes associated with the track portions at opposite ends of the gap.

10. An endless loop conveyor having tracks for supporting driverless vehicles capable of being stopped at predetermined locations along the length of the conveyor, each vehicle having a drive wheel for driving contact with a drive tube, each drive wheel being movable between a drive position and an accumulation position, means biassing each drive wheel to its drive position, the improvement comprising an unobstructed gap in said conveyor, means to intermittently facilitate access across the conveyor through a portion of said gap into the loop defined by the conveyor.

11. An endless loop conveyor having tracks for supporting driverless vehicles capable of being stopped at predetermined locations along the length of the conveyor, each vehicle having a drive wheel for driving contact with a drive tube, each drive wheel being movable between a drive position and an accumulation position, means biassing each drive wheel to its drive position, the improvement comprising means to intermittently facilitate access across the conveyor into the loop defined by the conveyor, said means including a gap in the conveyor tracks, a shuttle vehicle suspended by a frame from above and supported for reciprocatory movement across the gap from a vehicle receiving position at one end of the gap to a vehicle discharging position at the other end of the gap, a drive tube on the frame and driven by a reversible motor, a drive wheel on said shuttle vehicle and extending upwardly into contact with the last mentioned drive tube, said shuttle vehicle having a platform for supporting vehicles to be transported across said gap, a drive tube on the shuttle vehicle platform while being aligned with and adapted to contact an end of the drive tubes associated with the track portions at opposite ends of the gap, and the length of the shuttle vehicle being less than the length of the gap whereby an unoccupied portion of the gap is intermittently available as an access way for a wheeled motor driven vehicle.

* * * * *